United States Patent [19]

Neidecker

[11] 4,083,622

[45] Apr. 11, 1978

[54] ELECTRICAL CONNECTOR

[75] Inventor: Rudolf Neidecker, Basel, Switzerland

[73] Assignee: Multi-Contact AG, Allschwil, Switzerland

[21] Appl. No.: 697,613

[22] Filed: Jun. 18, 1976

[30] Foreign Application Priority Data

Jun. 21, 1975 Germany ..... 2527681

[51] Int. Cl.[2] ..... H01R 13/12

[52] U.S. Cl. ..... 339/256 R; 339/95 R

[58] Field of Search ..... 339/95, 255, 256

[56] References Cited

U.S. PATENT DOCUMENTS

| | | | |
|---|---|---|---|
| 3,157,735 | 11/1964 | Stroup et al. | 339/95 R |
| 3,411,128 | 11/1968 | Weinstein | 339/95 R |
| 3,453,587 | 7/1969 | Neidecker | 339/256 RT |
| 3,861,595 | 1/1975 | Deal | 339/95 R |

*Primary Examiner*—Joseph H. McGlynn
*Attorney, Agent, or Firm*—Karl F. Ross

[57] ABSTRACT

An electrical connector has two members whose surfaces are electrically bridged by means of a conductive strip with a multiplicity of substantially parallel lamellae bent from and integral with the strip. The interstices between the lamellae are filled with an elastic material in order to resiliently resist deformation of the lamellae and maintain at least the contact edges of the lamellae metallically bright.

10 Claims, 7 Drawing Figures

FIG. 1
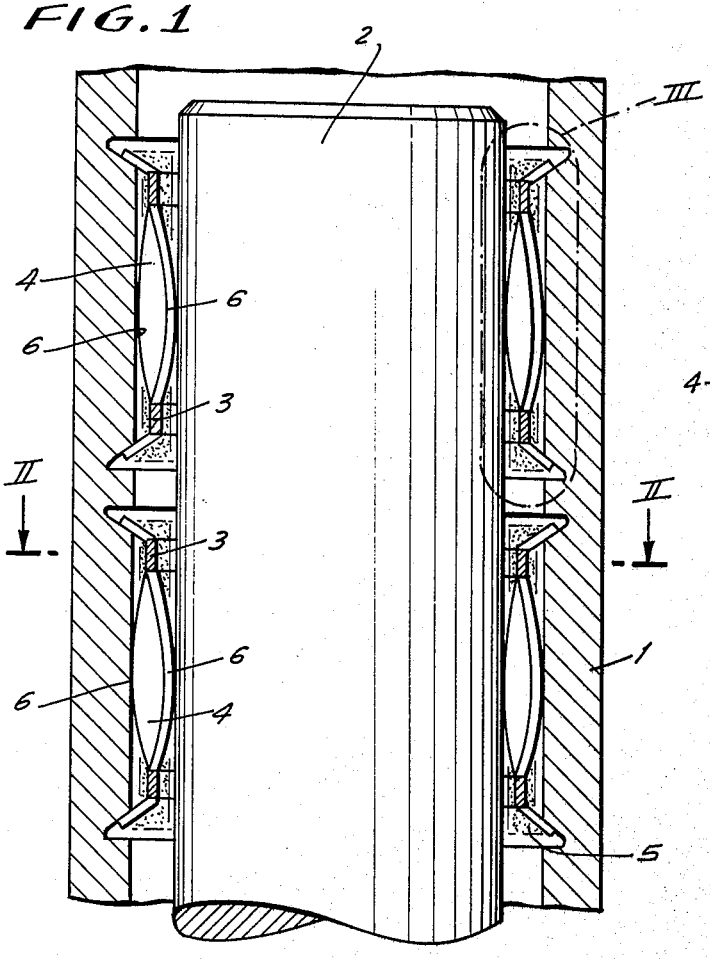
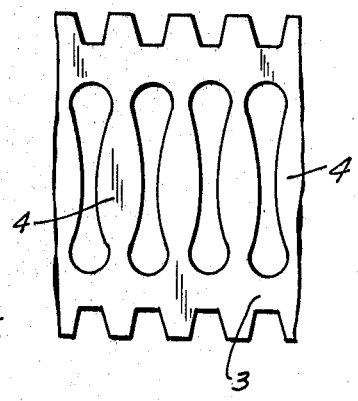
FIG. 3
FIG. 2
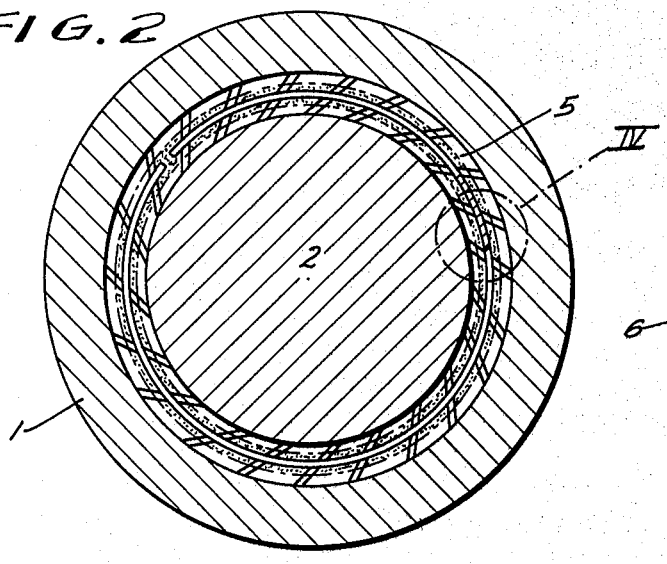
FIG. 4
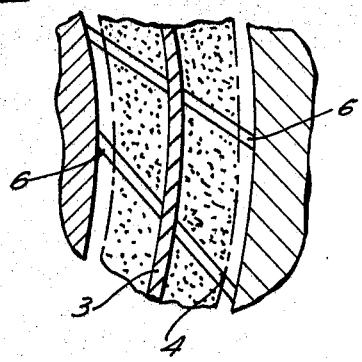

ELECTRICAL CONNECTOR

CROSS REFERENCE TO RELEVANT PATENTS

This application discloses improvements over my commonly assigned U.S. Pat. Nos. 3,845,451, 3,828,301 and 3,895,853 and earlier applications and patents mentioned therein.

FIELD OF THE INVENTION

The present invention relates to an electrical contact arrangement with at least two elements and at least one effective contact between them, in which the contact comprises a multiplicity of resilient lamella or blades with contact edges beyond the plane of the contact. More particularly the invention deals with improvements in the thermal, electrical and mechanical properties of such electrical connectors.

BACKGROUND OF THE INVENTION

An electrical connector which uses a multiplicity of lamellae bent out of the plane of a contact strip in order to effect a connection between adjoining surfaces of the desired members has already been described in U.S. Pat. No. 3,453,587 issued July 1, 1969.

Such connectors can be applied to many different applications, on surfaces of virtually any profile, flat or curved and have been highly successful. However, certain limitations arise on extended or heavy use.

Since the effectiveness of the contact depends on the firm pressure of the edges of the lamellae on the electrical members, any force on the lamellae which exceeds their elastic limit will permanently deform the lamellae, possibly interrupting the electrical contact of these lamellae. Under high current loads, the efficiency of the circuit may be adversely effected by heat build-up in the lamellae themselves and contact loss inherent in use of such small conductors. The lamellae are also prone to tarnishing and corrosive build-up, especially from moisture trapped in the interstices.

OBJECTS OF THE INVENTION

It is an object of the present invention therefore to improve electrical connectors of the above general type.

A second object is to minimize possible detrimental effects of extended use under high current loads characteristic of the prior art.

SUMMARY OF THE INVENTION

The objects are achieved according to the present invention in an electrical connector of the above-described general type wherein an elastic material fills the interstices between the lamellae.

This feature of the invention increases the effective plasticity of the lamellae by the combination of the resiliency of the added filler with that of the lamellae. The elastic material can improve the electrical contact by also being a conductor of electricity and of heat. The contact points can carry current better if kept metallically bright by a polishing and sealing action of the elastic material. Furthermore, the elastic filler can act to seal moisture out of the interstices and to prevent the damaging interaction of any broken part with the connected elements. Finally, the elastic material can be provided with a lubricant to aid movement of the elements.

BRIEF DESCRIPTION OF THE DRAWING

The above and other features, advantages and objects of my invention can be more readily understood from the following, reference being made to the accompanying drawing in which:

FIG. 2 is a cross section through the connector of FIG. 1 along line II — II;

FIG. 3 is a developed view of area III of the contact elements of FIG. 1;

FIG. 4 is an enlarged detailed view of area IV of FIG. 2;

FIG. 7 is a cross section of the contact elements along line VII — VII of FIG. 6.

SPECIFIC DESCRIPTION

Figure 1:
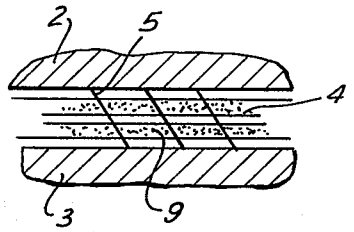
FIG. 1 is an axial sectional view of a plug-and-jack connector according to the invention.

As shown in FIG. 1, the preferred embodiment establishes electrical connection between the two elements 1 and 2 by means of a contact 3. The contact 3 comprises a plurality of lamellae 4, seen in FIG. 3, which are bent out of the plane of the contact strip 3 itself. In this preferred embodiment, the elements to be connected 1,2 are formed as a cylindrical jack 1 and a cylindrical plug 2, the contact strip 3 follows the curve of the jack 1, and the lamellae are wider at a middle waist region than at their respective ends.

FIG. 2 shows how the bent lamellae 4 of contact strip 3 provide an electrical connection between the jack 1 and the plug 2. At their narrow regions of connection with the balance of the strip, the lamellae which have a middle region of greater width than their ends, form junctions which are subject to torsion stress. Since the lamellae or blades are supported by the elastic mass the resistance to torsional displacement increases as a function of displacement (depending upon the spring constant of the mass) and breakage is prevented as is the possibility that the elastic limit of the junction will be exceeded.

FIG. 4 shows most clearly how the contact strip 3 is surrounded by an elastic material 5, so that the contact points or edges 6 remain metallically bright. The resilient elastic material 5 should be a good conductor of electricity and heat, an elastomer (rubber) or silica-gel matrix containing silver, copper or graphite powder, any of which might be mixed with a lubricant, such as molybdenum disulfide. As seen in FIG. 4, the resiliency of the elastic material 5 aids in increasing the effective plasticity of the lamellae 4, both preventing deformation of the lamellae 4 and aiding the grip of the jack 1 and the plug 2.

When the embedding mass is a vulcanizable rubber, it can be bonded to the jack 1 and the contact strip by vulcanization to assist in fixing the strip in place. Even when vulcanization is not used the frictional contact of the mass with the wall of the jack can prevent it from shifting axially or rotating therein.

Figure 5:
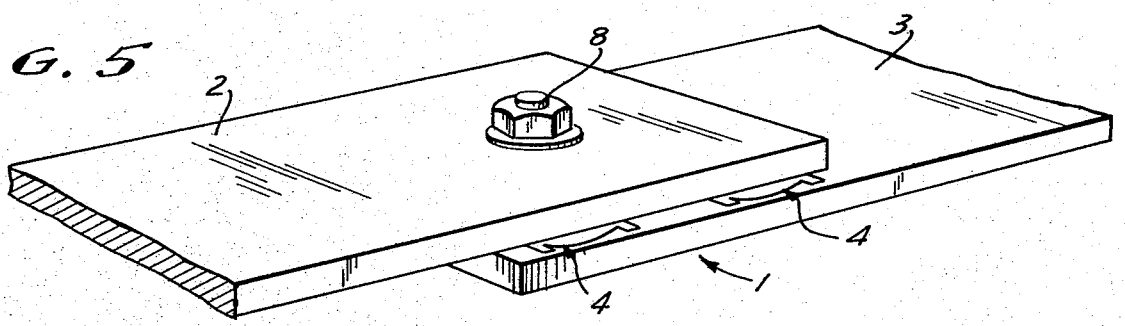
FIG. 5 is a perspective view of a busbar electrical connector embodying my invention.
Figure 6:
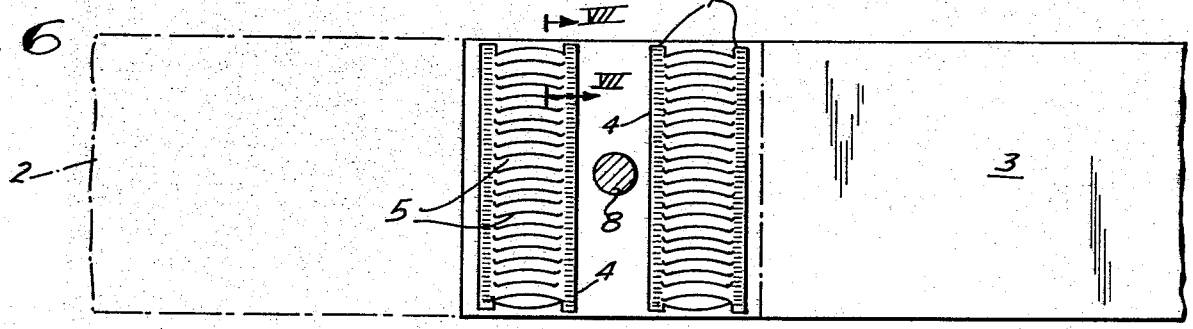
FIG. 6 is a top view of the lower busbar of FIG. 5.

FIG. 5 gives another embodiment of the invention, in which an electrical contact 1 is made between two flat busbars 2,3 and ensuring firm contact between them. FIG. 6 shows the arrangement of the two contact strips 4 transverse to the busbars, 2,3, the bolt 8 passing between them for even compression of the strips 4. FIG.

7 shows the elastic material 9 between the lamellae 5, its resiliency reinforcing that of the lamellae 5 to resist compression beyond their plastic limit.

Example of effective masses in which the conductor strips can be embedded are: 50% by weight silica gel, 49% by weight silver powder with a particle size of 10 to 20 microns, and 1% by weight molybdenum disulfide or graphite powder of up to 2 microns particle size; 20% by weight closed-pore polyurethane foam, 79% by weight copper powder with a particle size of 10 to 20 microns, and 1% by weight graphite flakes; and 60% by weight ABS rubber and 40% by weight of a mixture of equal parts by volume of silver and copper powder (10 to 20 microns particle size) and graphite flakes.

I claim:

1. In an electrical connector for two members having respective surfaces wherein a conducting element is interposed between and contacts said surfaces, said conducting element comprising a strip of resilient material with a multiplicity of lamellae integral with and bent from said strip and substantially parallel to one another defining interstices between them, the improvement wherein said interstices are filled with an elastic solid mass to resiliently resist deformation of said lamellae, said lamellae being twisted to lie transverse to a web of the strip and form contact edges on opposite sides of said web, each of said lamellae being connected to said web at twisted connection regions at their ends, said elastic solid mass being constructed and disposed in said interstices to keep contacting edges of the lamellae metallically bright, said mass flanking said web and said lamellae;

the elastic modulus of said elastic solid mass being such as to prevent deformation of said lamellae beyond the elastic limit of the element.

2. The improvement defined in claim 1 wherein said elastic solid mass is constructed and arranged to dissipate excess heat of said lamellae.

3. The improvement defined in claim 2 wherein said elastic solid mass is constructed and arranged to conduct electricity.

4. The improvement defined in claim 1 wherein said elastic solid mass is constructed and arranged to support any parts of said conducting element which may break off, preventing further damage by motion of the disengaged part.

5. The improvement defined in claim 4 wherein said elastic solid mass forms a seal which prevents the accumulation of moisture, thus reducing the possibility for damage by corrosion.

6. The improvement defined in claim 5 wherein said elastic solid mass comprises a rubber or silica gel matrix.

7. The improvement defined in claim 6 wherein said rubber or silicon gel matrix of said elastic solid mass contains an electrically conductive powder distributed in said matrix.

8. The improvement defined in claim 7 wherein said electrically conductive powder distributed in said matrix is copper, silver, or graphite powder.

9. The improvement defined in claim 7 wherein said matrix further contains a lubricant.

10. The improvement defined in claim 9 wherein said lamellae are constructed with a middle waist region substantially wider than their respective ends.

* * * * *